US005249965A

United States Patent [19]

Yianilos

[11] Patent Number: 5,249,965

[45] Date of Patent: Oct. 5, 1993

[54] ELECTRONIC WORD SELECTION MACHINE

[75] Inventor: Peter N. Yianilos, Princeton, N.J.

[73] Assignee: Franklin Electronic Publishers, Inc., Mt. Holly, N.J.

[21] Appl. No.: 926,050

[22] Filed: Aug. 6, 1992

[51] Int. Cl.[5] ..... A63F 9/00

[52] U.S. Cl. ..... 434/177; 273/153 R

[58] Field of Search ..... 364/419, 709, 710.03; 273/272, 153 R; 434/167, 169, 177, 172, 175, 168

[56] References Cited

U.S. PATENT DOCUMENTS 4,369,973 1/1983 D'Aurora et al. ..... 273/153 R 5,149,097 9/1992 Tonello et al. ..... 434/172 X

*Primary Examiner*—Richard J. Apley

*Assistant Examiner*—Glenn E. Richman

*Attorney, Agent, or Firm*—McAulay Fisher Nissen Goldberg & Kiel

[57] ABSTRACT

An improvement in a electronic crossword puzzle solving machine to provide alternate words for a word that is input on the keyboard. A first actuation of a function key labeled "Second-Guess" initiates a search in which all words in memory having the same number of letters as the input word but differing with respect to only one of those letters is displayed. A second actuation of the "Second-Guess" key results in a search and display of all words differing from the input word with respect to two of the letters. Each successive actuation of the "Second-Guess" key increases the number of letters by which the alternate words found differ from the input word.

9 Claims, 1 Drawing Sheet

ELECTRONIC WORD SELECTION MACHINE

BACKGROUND OF THE INVENTION

This invention relates in general to an electronic word selection machine and in particular to one having utility as an aide in solving crossword puzzles.

It is known to provide a crossword puzzle solving electronic device in which the user enters a partial word using spaces for the unknown letters. In such a machine, a seven letter word, for example, may be entered in which two of the letters (the second and fourth) are left blank. This is a typical situation in the course of solving a crossword puzzle. When a partial word is entered, a search routine is undertaken in which that partial word is matched against every word in the set of words held in memory. For the above example, each word having the five entered letters in that letter position is displayed on a screen. In this fashion, each possible solution for the partial word in the crossword is provided to the user. The user can then select whichever word appears to be most appropriate to the clue provided with the puzzle or to assist in solving a word that runs crosswise to a position in the partial word that has been entered.

Often, however, an individual who is entering a word that he or she is quite sure is the correct entry, realizes that one or more of the crosswords previously entered must be incorrect. That crossword may differ from the word previously entered in terms of the one letter that is common to the crossword and the word currently worked on. Often, it is clear the crossword must have two or more letters that are incorrect. But the user does not know what the alternates are. The crossword with only the common letter changed may not be a real word or it may not match the clue for the crossword.

In that circumstance, the user cannot enter a partial word representing the crossword into the crossword puzzle solver because the user does not know which letter or letters to omit.

Alternatively, a word may be filled in by virtue of the fact that all the crosswords have been filled in. Yet the word filled in may not appear to be appropriate. For example, it may not match the clue.

Accordingly, the purpose of this invention is to provide a technique in a hand held electronic crossword puzzle solving machine for presenting to the user alternate words to the one that the user believes is incorrect.

BRIEF DESCRIPTION

Figure 1:
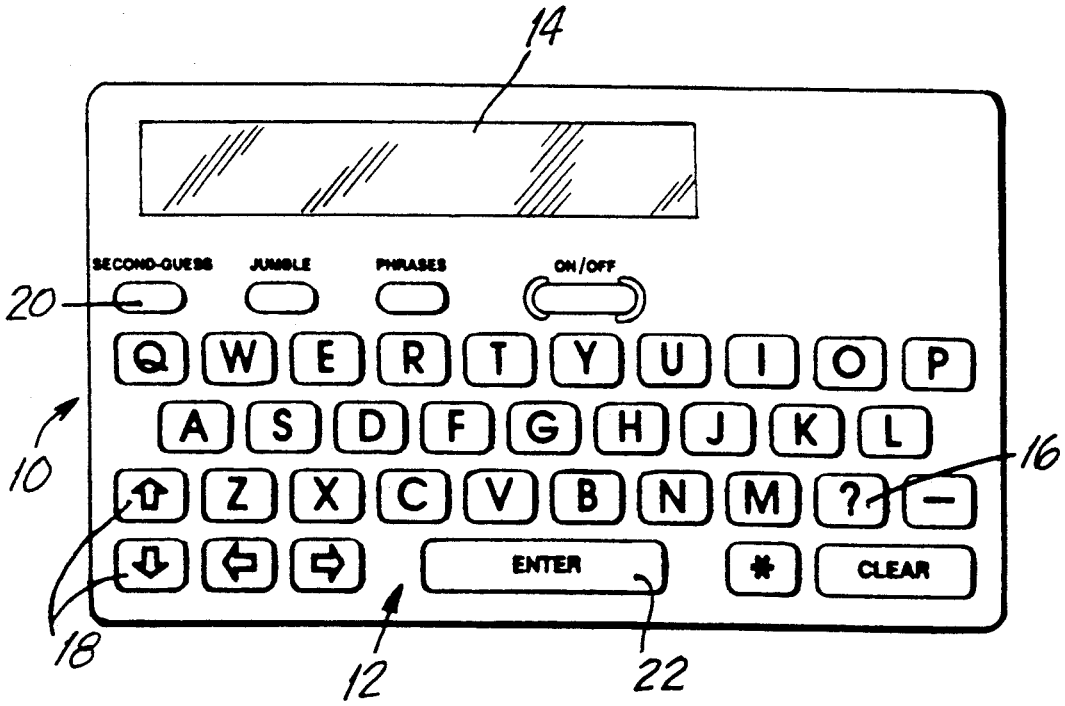
FIG. 1 is a plan view of a hand held device embodying the invention and showing the significant Second-Guess key which permits the user to obtain the function of this invention.

In brief, the invention is an improvement in a crossword puzzle solving hand held electronic device. The memory contains a predetermined set of words. The keyboard permits an operator to enter any desired word in whole or in part. If the user enters a partial word; for example ?O?L?A?L and then enters that partial word, a known type of search mechanism will compare the entered letters against all eight letter words in memory which have those entered letters in those positions. The result will be the term FOULBALL.

The improvement provided by this invention relates to the situation where a previously filled in word in the crossword puzzle does not appear correct because it makes it impossible to fill in one or more crosswords. This invention provides a function by which alternate words will be provided for the filled in word that is suspected to be incorrect. The user inputs the complete word which is believed to be incorrect and then presses a particular function button. In one embodiment that function key is labeled "Second-Guess".

The search routine now compares that entered word against all words in the set of words in memory having the same number of letters and provides on display only those words out of that same number of letters subset where one letter differs from the letter of the input word.

The user may find that those offered Second-Guess words are not satisfactory or, in some cases, there may be none. By pressing the Second-Guess function key a second time, a second comparison is made that provides on the screen all words in the memory which have the same number of letters as the input word in which either one or two of the letters are changed. Through a third or a fourth or any number (N) of successive actuations of the Second-Guess function, an extension of the Second-Guess set of words can be made to words having any user determined number of letters that differ from the input word.

Each letter and its position are kept in place except for the letters in the N positions determined by the N actuations of the Second-Guess function key.

PREFERRED EMBODIMENT

With reference to the figures, the hand held electronic device 10 of this invention includes a keyboard 12 and a display screen 14. The keyboard includes an input key for each letter of the alphabet, a question mark key is employed as a space holding key 16 to designate a space in an input partial word which space has an unknown letter. A set of up and down scroll keys 18 are important to permit the user to scroll through the words selected when one of the functions of this device is initiated by the user. The Second-Guess key 20 is a significant input key of this invention. The enter key 22 is important when entering a partial word in which spaces are held by the space holding key 16 so as to obtain a match between an entered partial word and all words in the memory which have the letters in position as entered. That function will not be discussed herein since it is a known function.

More importantly is the function associated with the Second-Guess key 20.

If the user sets a word up on the screen through the keyboard such as the word "cadger" and then actuates the SecondGuess key 20, the screen will display each six letter word in memory which is identical to the word "cadger" except for one letter being changed. Thus, setting up the word "cadger" and pressing the Second-Guess key 20 will provide words such as "badger", "cadges", "codger", "gadger" and "cadged". These words are displayed in sequence on the screen 14 by pressing the up and down scroll keys 18.

Each suggested word will display the changed letter in a different type format—for example, lower case. Thus the suggested word "badger" is displayed as bADGER, indicating that it is the first letter which is changed. Similarly, the other suggested words will be displayed as CADGEs, CoDGER, gADGER and cADGEd.

Each time the Second-Guess key 20 is actuated, the system will treat an additional letter in the input word as variable. For example, if the word "crosswords" is the input word, the first time the Second-Guess key 20 is actuated, no additional word will be found because there is no word in the set of words in memory which differs from "crosswords" by only one letter. However, on the second pressing of the Second-Guess key, two words will be found; namely, the words "crosswinds" and "crossroads".

By pressing the Second-Guess key 20 a third time, a third list of words is created which will include: brassworks, crossfires, crosswinds, grasswards, pressworks, crosswalks, crosswinds, crossheads and crossbones. Each of these additional words differs from the input word "crosswords" by three letters.

A fourth actuation of Second-Guess will add to the suggested list of words the following: catchwords, clockworks, cloudwards, coastwards, crossbeams, crossbills, crossbones, crossovers, crosspoint and a number of other words having four letters which differ from the input word "crosswords".

The sequence of operations and display are as follows:

1. User inputs query word; for example "CROSSWORDS".
2. User actuates a Second-Guess key 20 and the screen displays "Getting More" while a search is made.
3. Screen displays "CROSSWORDS".
4. User scrolls using up and down scroll keys 18 and screen displays "End of List".
5. User actuates Second-Guess key 20 a second time.
6. The screen displays legend "Getting More" while a search is made.
7. The screen displays the word "CROSSROADS" and a flashing downward pointing arrow to indicate that there is list for the user to scroll through.
8. The user scrolls through the scroll keys 18 and obtains the word "CROSSWinDS " and the word "CROSSWORDS" and finally "End Of List".
9. The user actuates the Second Guess key a third time.
10. The screen displays "Getting More" while a search is made.
11. At the end of the search, screen displays the word: "bRaSSWORkS" together with the flashing downward pointing arrow.
12. The user scrolls through list to and screen displays in sequence the following:
    CROSSfiReS
    CROSSBOneS
    CROSSheaDS
    CROSSroaDS
    CROSSWalkS
    CROSSWinDS
    CROSSWORDS
    gRaSSWaRDS
    pReSSWORkS
    End Of List Note that on the third actuation of the Second-Guess key 20, the additional search provides words where three letters are changed but seven letters remain unchanged in position and values.

APPENDIX

The following fourteen pages are a presently preferred listing in "C" Source Code of those routines pertinent to the invention. This listing is by way of an example of routines for implementing the Second-Guess function. A skilled programmer may implement the invention by means of a different code listing.

There are a number of straight forward subservient routines which are not shown, such as the scroll codes, which one skilled in the art could readily implement. Furthermore, it should be understood that the particular technique of taking words from the data base is a function of the date base employed. Since the data base employed is not as such a part of the invention claimed, the codes for interfacing the particular data base employed in an embodiment of this invention are not shown. One skilled in the art would know how to provide an appropriate process for interfacing with whatever data base is employed.

In addition, it might be noted that commercial embodiments of this invention are likely to include many other functions such as games, hyphenation and spelling correction, all of which involve routines and processing separate from the word list build up which is the focal point of this invention.

```
        UCHAR   *pattern;       /* Trying to match words with this pattern. */
        BOOL    continu;        /* For continuations. */
{
        UCHAR   prefix_lvl;     /* Trie level down without wildcards. */
        UCHAR   min_size;
        UCHAR   max_size;
        UCHAR   *flagptr;
        UCHAR   i, size;
        int     temp;
        static  UCHAR   nwords;
        UCHAR   word[MAXWORD];
        static  UCHAR   spaces[MAXWORD];

        if (Match_phrases) {
                size = LENSTR(pattern) - 1;
                if ( (pattern[0] == '*') && (pattern[size] == '*') ) {
                        temp = 0;
                        for (i = 1; i < size· i++) {
                                if (pattern[i] == '*') {
                                        temp = 1;
                                        break;
                                }
                        }
                        if (!temp) {
```

```
                return phrases_maker(pattern, continu);
                }
        }
}

init_word_list();

min_size = 0;
prefix_lvl = 0xFF;

for (i = 0; pattern[i]; i++) {
        if (pattern[i] == '*') {
                if (prefix_lvl == 0xFF) {
                        prefix_lvl = i;
                }
        }
        else {
                        ++min_size;
                }
        }

        max_size = 0;
        if (prefix_lvl == 0xFF) {
                prefix_lvl = max_size = min_size;
        }

        if (continu) {
                goto continue_list;
        }

        st_rootinit();
        spaces[0] = spaces[1] = 0;

        while (TRUE) {
                while (!st_traverse()) {
                        if (Lvl == 0) {
                                /* End of the trie; done with search. */

                                Spell_status = FULLLIST;
                                return List_count;
                        }
                }

                if (Match_phrases) {
                        if (Demo && (Lvl == 2)) {
                                asic_disp_char_no_copy(TO_UPPER(Currword[Lvl-2]), 9);
                                asic_disp_char_no_copy(TO_UPPER(Currword[Lvl-1]), 10);
                        }

                        if (Currword[Lvl-1] == SPACE) {
                                spaces[Lvl] = spaces[Lvl-1] + 1;
                        }
                        else {
                                spaces[Lvl] = spaces[Lvl-1];
                        }
                }

                for (i = size = 0; i < Lvl; i++) {

                if (    (Currword[i] == '-') ||
                        (Currword[i] == 0x27) ||
                        (Currword[i] == SPACE)
                    ) {
                        ;
                }
                else {
                        size++;
                }
        }

        /* See if we can prune past this sub-trie. If the prefix
        in the trie does not match that of our query, do it. */
```

```
        if ( (Lvl <= prefix_lvl) && (Lvl == size) ) {
                if (!More_expand) {
                        if (pattern[Lvl - 1] != '?' &&
                                pattern[Lvl - 1] !=
                                To_canon_table[Currword[Lvl - 1]]) {
                                continue;
                        }
                }
                else {
                        temp = More_expand;
                        for (i = 0; i < Lvl; i++) {
                                if (pattern[i] != '?' &&
                                        pattern[i] !=
                                        To_canon_table[Currword[i]]) {
                                        temp--;
                                        if (temp < 0) {
                                                break;
                                        }
                                }
                        }
                        if (temp < 0) {
                                continue;
                        }
                }
        }

        if (Lvl >= min size && (Node flags & IS VALID)) {

            /* We have a word from the trie which fits the size
            restrictions. See if it matches our pattern. */

            if (Match_phrases & !spaces[Lvl]) {
                    ;
            }
            else {
                    if (pattern_match(Currword, pattern)) {
                            /* It does match our pattern. Add all forms of
                            this word. */

                            if (Node_flags & HAS_TAG) {
                                    nwords = nd_numtags;
                            }
                            else {
                                    nwords = 1;
                            }

continue_list:
                            while (nwords) {
                                    if (Node_flags & HAS_TAG) {
                                            flagptr = tr_flag_addr(nwords - 1);
                                            tg_getflag(flagptr, &Trie_flags);
                                            tg_undoflags(Currword, &Trie_flags, word);
                                    }
                                    else {
                                            MOVSTR(Currword, word);
                                    }
                                    if (!Demo || !Match_phrases) {
                                            if (!add_list(word)) {
                                                    Spell_status = PARTLIST;
                                                    More_list = MORE_PATTERN;
                                                    return List_count;
                                            }
                                    }
                                    else {
                                            add_list(word);
                                            Spell_status = PARTLIST;
                                            More_list = MORE_PATTERN;
                                            nwords--;
                                            return List_count;

                                            }
                                            nwords--;
                                    }
                            }
```

```
                }
        }

        if ( (Lvl != max_size) || (size < max_size) ) {
                st_dn_set();
        }

    }
}

/*****************************************************************************/
/* Compare a word with a match maker pattern. Return TRUE if the word fits the
pattern. */

BOOL
pattern_match(qword, pattern)
        UCHAR   *qword;
        UCHAR   *pattern;
{
        register UCHAR  *p, *q, pc, qc;
        register int    sx;
        register BOOL   match;
        UCHAR   pstack[MAX_WILDCARD], qstack[MAX_WILDCARD];
        UCHAR   estack[MAX_WILDCARD];
        UCHAR   *pbeg, *qbeg;
        int     expand;

        sx = -1;
        qbeg = qword;
        pbeg = pattern;
        expand = 0;

        while (TRUE) {
                if (sx >= 0) {
                        p = pbeg + pstack[sx];
                        qword = qbeg + qstack[sx] + 1;
                        expand = estack[sx];
                        sx--;
                        if (!*qword) {
                                return FALSE;
                        }
                }
                else {
                        p = pattern;
                }
                q = qword++;
                if (!*q) {
                        return FALSE;
                }
                while (TRUE) {
                        if ( (!*p) && (!*q) ) {
                                return TRUE;
                        }

                        if ( (*p == '*') && (!p[1]) ) {
                                return TRUE;
                        }

                        if (!*q) {
                                break;
                        }

                        if (    (*q == SPACE) ||
                                (*q == '-') ||
                                (*q == 0x27)
                           ) {
                           q++;
                        }
                        else if (*p == '*') {
                                match = FALSE;
                                pstack[sx+1] = p - pbeg;
                                qstack[sx+1] = q - qbeg;
```

```
                        estack[sx+1] = expand;
                        while (*p == '*') {
                                if (!*q) {
                                        break;
                                }
                                if ( (To_canon_table[*q] == p[1])
                                        || (p[1] == '?')
                                ) {
                                        p += 2;
                                        q++;
                                        match = TRUE;
                                        break;
                                }
                                else {
                                        q++;
                                }
                        }
                        if (!match) {
                                return FALSE;
                        }
                        else {
                                sx++;
                                pattern = p;
                                qword = q;
                        }
                }
                else if (*p == '?') {
                        q++;
                        p++;
                }
                else if (To_canon_table[*q++] != *p++) {
                        if (expand < More_expand) {
                                expand++;
                                continue;
                        }
                        if (sx >= 0) {
                                break;
                        }
                        else {
                                return FALSE;
                        }
                }
        }
    }
}

/*****************************************************************************/

BOOL
mark_expand(qword, pattern)
        UCHAR   *qword;
        UCHAR   *pattern;
{
        register UCHAR  *p, *q, pc, qc;
        register int    sx;
        register BOOL   match;
        UCHAR   pstack[MAX_WILDCARD], qstack[MAX_WILDCARD];
        UCHAR   estack[MAX_WILDCARD];
        UCHAR   *pbeg, *qbeg;
        int     expand;

        sx = -1;
        qbeg = qword;
        pbeg = pattern;
        expand = 0;

        while (TRUE) {
                if (sx >= 0) {
                        p = pbeg + pstack[sx];
                        qword = qbeg + qstack[sx] + 1;
                        expand = estack[sx];
                        sx--;
                        if (!*qword) {
                                return FALSE;
```

```
        }
        q = qword;
        while (*q) {
                *q = TO_LOWER(*q);
                q++;
        }
}
else {
        p = pattern;
}
q = qword++;
if (!*q) {
        return FALSE;
}
while (TRUE) {
        if ( (!*p) && (!*q) ) {
                return TRUE;
        }

        if ( (*p == '*') && (!p[1]) ) {
                return TRUE;
        }

        if (!*q) {
                break;
        }

        if (    (*q == SPACE) ||
                (*q == '-') ||
                (*q == 0x27) ||
                (*q == '.')
           ) {
           q++;
        }
        else if (*p == '*') {
                match = FALSE;
                pstack[sx+1] = p - pbeg;
                qstack[sx+1] = q - qbeg;
                estack[sx+1] = expand;
                while (*p == '*') {
                        if (!*q) {
                                break;
                        }
                        if ( (To_canon_table[*q] == p[1])
                                || (p[1] == '?')
                           ) {
                                p += 2;
                                q++;
                                match = TRUE;
                                break;
                        }
                        else {
                                q++;
                        }
                }
                        if (!match) {
                                return FALSE;
                        }
                        else {
                                sx++;
                                pattern = p;
                                qword = q;
                        }
                }
                else if (*p == '?') {
                        q++;
                        p++;
                }
                else if (To_canon_table[*q] != *p) {
                        if (expand < More_expand) {
                                expand++;
                                *q = TO_LOWER(*q);
                                q++;
```

```
                                        p++;
                                        continue;
                                }
                                q++;
                                p++;
                                if (sx >= 0) {
                                        break;
                                }
                                else {
                                        return FALSE;
                                }
                        }
                        else {
                                q++;
                                p++;
                        }
                }
        }
}

/*****************************************************************************/

UCHAR
phrases_maker(pattern, continu)
        UCHAR   *pattern;       /* Trying to match words with this pattern. */
        BOOL    continu;        /* For continuations. */
{
        static  UCHAR   nwords;
        UCHAR   word[MAXWORD];
        static  UCHAR   spaces[MAXWORD];
        UCHAR   *flagptr;

        init_word_list();

        if (continu) {
                goto continue_list;
        }

        st_rootinit();
        spaces[0] = spaces[1] = 0;

        while (TRUE) {
                while (!st_traverse()) {
                        if (Lvl == 0) {
                                /* End of the trie; done with search. */

                                Spell_statu = FULLLIST;
                                return List_count;
                        }
                }

                if (Demo && (Lvl >= 2)) {
                        asic_disp_char_n_copy(TO_UPPER(Currword[Lvl-2]), 9);
                        asic_disp_char_n_copy(TO_UPPER(Currword[Lvl-1]), 10);
                }

                if (Currword[Lvl-1] == SPACE) {
                        spaces[Lvl] = spaces[Lvl-1] + 1;
                }
                else {
                        spaces[Lvl] = spaces[Lvl-1];
                }

                if ( (Node_flags & IS_VALID) && (spaces[Lvl]) ) {

                if (pattern_match(Currword, pattern)) {
                        /* It does match our pattern. Add all forms of
                        this word. */

                        if (Node_flags & HAS_TAG) {
                                nwords = nd_numtags;
                        }
                        else {
```

```
                        nwords = 1;
                }

continue_list:
                        while (nwords) {
                                if (Node_flags & HAS_TAG) {
                                        flagptr = tr_flag_addr(nwords - 1);
                                        tg_getflag(flagptr, &Trie_flags);
                                        tg_undoflags(Currword, &Trie_flags, word);
                                }
                                else {
                                        MOVSTR(Currword, word);
                                }
                                if (Demo) {
                                        add_list(word);
                                        Spell_status = PARTLIST;
                                        More_list = MORE_PATTERN;
                                        nwords--;
                                        return List_count;
                                }
                                else {
                                        if (!add_list(word)) {
                                                Spell_status = PARTLIST;
                                                More_list = MORE_PATTERN;
                                                return List_count;
                                        }
                                }
                                nwords--;
                        }
                }
        }

        st dn set();
    }
}

/*****************************************************************************/
```

What is claimed is:

1. In a word selection machine having a predetermined set of words in memory and having matching means for matching an input partial word against said set of words to provide a suggested word, the improvement in providing alternate suggested words comprising:

keyboard means to provide a user selected input word, a display screen to display said user selected input word, a predetermined function key on said keyboard, first search means responsive to a selected input word of Y letters and a first actuation of said function key to provide on said display screen a first list of Y letter long words from said set of words in memory, each member of said first list of words differing from said input word by one letter.

2. The improvement of claim 1 further comprising:

second search means responsive to a second actuation of said function key to provide on said display screen a second list of Y letter long words from said set of words in memory, each member of said second list of words differing from said input word by two letter-positions.

3. The improvement of claim 1 further comprising:

indicia means to indicate which letter on each member of said first list of words differs from the corresponding positioned letter of said input word.

4. The improvement of claim 2 further comprising:

indicia means to indicate which letters of said second list of words differ from the letters in the corresponding letter positions of said input word.

5. The improvement of claim 2 wherein said first and second list of words are both displayed in response to a search by said second search means.

6. The improvement of claim 3 wherein said indicia means constitute displaying said differing letter in a different typeface.

7. The improvement of claim 4 wherein said indicia means constitutes displaying said differing letters in a different typeface.

8. In a word selection machine having a predetermined set of words in memory and having matching means for matching an input partial word against said set of words to provide a suggested word, the improvement in providing alternate suggested words comprising:

keyboard means to provide a user selected input word, a display screen to display said user selected input word, a predetermined function key on said keyboard, search means responsive to a selected input word of Y letters and a Nth actuation of said function key to provide on said display screen a list of words from said set of words in memory, each member of said list of words having Y letters and having at least (Y−N) letters the same in value and position as said input word.

9. In an electronic crossword puzzle solver wherein a user entered partial word having Y letter positions will provide a plurality of words with the Y letter positions filled in from a predetermined list of words in memory, the improvement in providing alternate words for fully entered words comprising:

matching means responsive to a user entered complete N letter input word to compare said input word with the predetermined set of words in memory to provide a list of alternate words, said alternate words constituting those words in memory having Y letters in which Y−1 letters correspond in designation and position with Y−1 letters of said input word, display means to display each of said words from said list of alternate words, said display means including means to uniquely designate the letter of said alternate word which does not match the corresponding letter of said input word.

* * * * *